United States Patent [19]

Spivey et al.

[11] Patent Number: 4,976,562

[45] Date of Patent: Dec. 11, 1990

[54] DISPENSER

[75] Inventors: James R. Spivey, Irvine; William J. Dee, Chino; William F. Brice, Lakewood, all of Calif.

[73] Assignee: Spiveco, Inc., Anaheim, Calif.

[21] Appl. No.: 463,936

[22] Filed: Jan. 8, 1990

Related U.S. Application Data

[63] Continuation of Ser. No. 274,920, Nov. 22, 1988, abandoned, which is a continuation-in-part of Ser. No. 198,390, May 24, 1988, Pat. No. 4,880,326.

[51] Int. Cl.[5] ..... A45D 40/00; A45D 40/06

[52] U.S. Cl. ..... 401/123; 401/124; 401/126; 401/130; 401/175; 401/191

[58] Field of Search ..... 401/123, 124, 126, 127, 401/129, 130, 191, 175, 192; 132/289, 290

[56] References Cited

U.S. PATENT DOCUMENTS

| | | | |
|---|---|---|---|
| Re. 21,757 | 4/1941 | Deakers et al. | 132/79 |
| 1,309,900 | 7/1919 | MacCorkell | 401/175 |
| 1,362,808 | 12/1920 | McFarland | 401/130 |
| 1,497,442 | 6/1924 | Hess | 401/129 |
| 1,643,815 | 9/1927 | Lesquendieu | 401/130 |
| 2,193,509 | 3/1940 | Deakers et al. . | |
| 2,311,367 | 4/1940 | Chambers | 221/147 |
| 2,320,749 | 1/1943 | Pressentin | 221/79 |
| 2,442,503 | 1/1948 | Melnikoff | 132/88.7 |
| 2,620,499 | 12/1952 | Dressel | 15/140.3 |
| 2,917,765 | 12/1959 | Jakubowski | 15/137 |
| 3,100,315 | 8/1963 | Laxalt | 15/558 |
| 3,121,905 | 2/1964 | Shapiro | 15/552 |
| 3,185,345 | 5/1965 | Hunegs | 222/45 |
| 3,195,545 | 7/1965 | Lederberg et al. | 132/79 |
| 3,226,762 | 1/1966 | Norman | 15/558 |
| 3,246,657 | 4/1966 | Roller | 132/79 |
| 3,384,547 | 5/1968 | Palmerio et al. | 167/85 |
| 3,589,821 | 6/1971 | Barney et al. . | |
| 3,802,023 | 4/1974 | Spatz . | |
| 3,807,881 | 4/1974 | Seidler . | |
| 4,071,300 | 1/1978 | Nichols et al. . | |
| 4,139,127 | 2/1979 | Gentile . | |
| 4,201,490 | 5/1980 | D'Angelo . | |
| 4,269,207 | 5/1981 | Konrad et al. . | |
| 4,348,126 | 9/1982 | Nigro . | |
| 4,363,560 | 12/1982 | Gentile . | |
| 4,552,161 | 11/1985 | Hill et al. . | |
| 4,664,547 | 5/1987 | Rosenwinkel . | |
| 4,780,017 | 10/1988 | Bradford | 401/130 X |
| 4,880,326 | 11/1989 | Spivey et al. . | |

FOREIGN PATENT DOCUMENTS

| | | | |
|---|---|---|---|
| 496055 | 10/1919 | France | 401/175 |
| 36749 | 3/1929 | France . | |
| 727609 | 3/1932 | France | 401/175 |
| 2619690 | 8/1987 | France . | |
| 213504 | 5/1941 | Switzerland | 401/192 |
| 449869 | 4/1968 | Switzerland | 401/130 |
| 15419 | of 1910 | United Kingdom | 401/130 |
| 314959 | 1/1930 | United Kingdom . | |
| 500020 | 2/1939 | United Kingdom | 401/130 |
| 1098166 | 7/1965 | United Kingdom . | |

*Primary Examiner*—Steven A. Bratlie

*Attorney, Agent, or Firm*—Gordon L. Peterson; Frank J. Uxa, Jr.

[57] ABSTRACT

A dispenser for a cosmetic comprising:

an applicator member and a cover member that can be separated for use and joined for storage;

the applicator member including an applicator tip to be used for cosmetic application purposes; and the cover member defining a compartment adapted to contain a supply of cosmetic, the cover member including a first cover portion, a second cover portion and an extrusion mechanism, the extrusion mechanism operable for moving an amount of cosmetic from the compartment in response to moving the first cover portion relative to the second cover portion.

17 Claims, 1 Drawing Sheet

DISPENSER

RELATED APPLICATION

This application is a continuation of Application Ser. No. 274,920 filed Nov. 22, 1988 and also entitled DISPENSER now abandoned, which is a continuation-in-part of Ser. No. 198,390 filed May 24, 1988 which is now U.S. Pat. No. 4,880,326.

BACKGROUND OF THE INVENTION

1. Technical Field

This invention relates generally to dispensers for flowable or extrudable materials, and more particularly to dispensers for extrudable cosmetics and the like.

2. Background Information

Some cosmetic, e.g., lipstick, dispensers employ a two-piece unit about the size of a fountain pen, one piece serving as an applicator and the other as a cover for the applicator tip. The unit contains a supply of cosmetic within the applicator along with an extrusion mechanism that operates to dispense a desired amount of cosmetic onto the tip. Cosmetic application with a dispenser of this type has become widespread and so the details of construction and operation are important.

Use of the unit involves grasping the cover with one hand and the applicator with the other in order to separate them with a slight tug like two pieces of a pen. Then, releasing the cover, the user rotates the two ends of the applicator relative to each other in order to operate the extrusion mechanism within. This extrudes the desired amount of cosmetic for application. After application of the cosmetic, the user places the cover back over the tip.

Although this arrangement is convenient in some respects, there are certain drawbacks that need to be overcome. For example, some cosmetic dispensers carry the supply of cosmetic within the body of the applicator and they operate to extrude the cosmetic through the applicator tip toward the outer surface of the tip. But this arrangement may result in an uneven distribution of cosmetic across the tip surface as well making the applicator heavier and/or longer than desired for optimum results.

Furthermore, the extrusion mechanism is often somewhat complicated, costly to fabricate, and inconvenient to operate. For example, it may include a piston within the applicator that can be advanced against the cosmetic supply for extrusion purposes by rotating the tip end of the applicator relative to the other end of the applicator. However, this is sometimes difficult to do without setting down or at least releasing the cover in order to free both hands for operation of the extrusion mechanism. This may, in turn, result in extra time and effort, as well as the possibility of misplacing the cover.

It would be advantageous to have a new dispenser that overcomes these concerns.

SUMMARY OF THE INVENTION

A new dispenser for extrudable materials, e.g., cosmetics and the like, has been discovered. The present dispenser has both the extrusion mechanism and the supply of material to be extruded in the cover or cover member. The applicator plays substantially no role in the extrusion process. Thus, the material is extruded without first passing through the applicator tip. This avoids the problems of uneven distribution and excessive applicator weight and/or length noted above. Further, extrusion of the material can occur with the applicator secured to the cover or with the applicator separated from the cover. For example, the initial extrusion can occur with the applicator secured to the cover. This provides an amount of material to the applicator tip. The user may desire to rotate the applicator relative to the cover to get a more even distribution of the material on the tip. This can be done without extruding more material. Further, during use, the user may desire to redistribute the material on the applicator tip and/or pick up additional material which has already been extruded in the cover member. This can easily be done by placing the applicator back into the cover member and rotating the applicator relative to the cover member. This rotation does not extrude additional material.

Of course, if it is desired to extrude additional material for use, this can be done simply by moving the two parts of the cover member relative to each other. The present dispenser has particular applicability for dispensing extrudable cosmetics. Thus, this dispenser is described hereinafter with reference to such cosmetics. However, it is understood that the present system may be used to dispense other extrudable materials.

In one broad aspect of the invention the present dispenser comprises an applicator member and a cover member that can be separated for use and joined for storage. The applicator member includes an applicator tip to be used for application. The cover means defines a compartment adapted to contain a supply of cosmetic. The cover member includes a first cover portion, a second cover portion and an extrusion mechanism. This mechanism is operable for moving an amount of cosmetic from the compartment in response to moving the first cover portion relative to the second cover portion.

As used herein, the term "cosmetic" refers to any substance which is extrudable using the present system and which can be applied to one or more parts of a human's body for medicinal and/or beauty purposes. Examples of cosmetics include, lipstick, lip balm, eye make-up, sun screens, tanning preparations and the like. The present dispenser is especially useful for dispensing lipstick.

These and other aspects and advantages of the present invention are set forth in the following detailed description and claims, particularly when considered in conjunction with the accompanying drawings in which like parts bear like reference numerals.

DETAILED DESCRIPTION OF THE DRAWINGS

Figure 3:
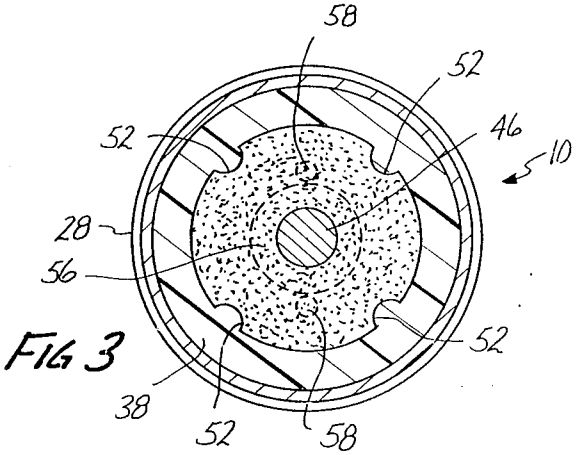
FIG. 3 is an enlarged cross-sectional view taken along line 3—3 of FIG. 2.
Figure 1:
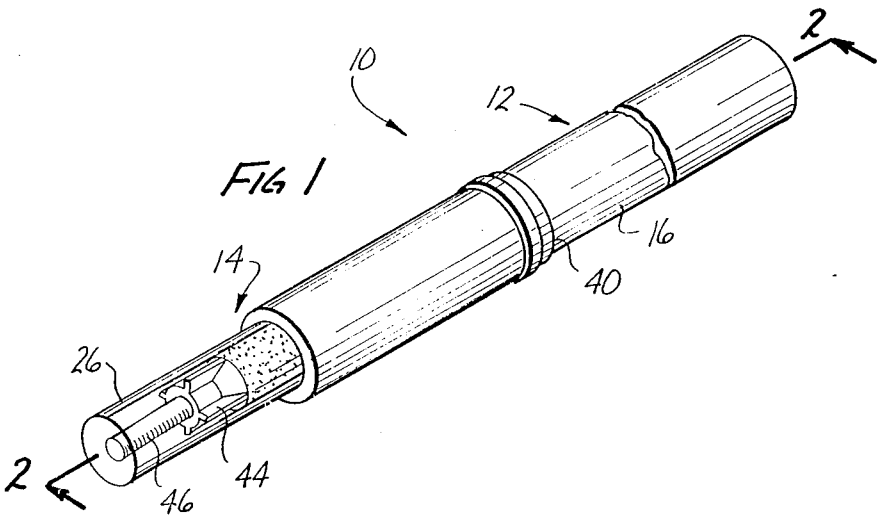
FIG. 1 is a front top view, in perspective, of a cosmetic dispenser constructed according to the present invention.

Referring now to the drawings, there is shown a dispenser 10 constructed according to the present invention. Dispenser 10 includes an applicator member or applicator 12 and a cover member or cover 14. These can be separated for use and rejoined for storage.

The applicator 12 includes a hollow handle 16 composed of a suitably rigid material, e.g., a metal alloy, and it is joined with a cylindrically shaped plastic plug 18 to a forward portion 20 of the applicator 12. The forward portion 20 has a neck 22 that extends to an applicator tip or tip 24 which is used for cosmetic application purposes.

For this purpose the tip 24 may be composed of a closed cell neoprene foam rubber material, for example, that is skinned to exposed some surface cells. Other tip materials may be employed, however, within the broader inventive concepts disclosed.

The cover 14 includes a canister 26 and a sleeve 28 which are movable relative to each other, as will be discussed hereinafter. The canister 26 and sleeve 28 may be composed of any suitably rigid material or materials. In one particularly useful embodiment, the canister 26 is made of plastic, and the sleeve 28 is made of metal alloy. This combination is particularly attractive since the component parts are relatively easy to fabricate and assemble. In addition, in one embodiment, the canister 26 is transparent or semi-transparent which allows the user to determine how much cosmetic is left in dispenser 10.

Canister 26 defines a hollow interior or compartment 30 which extends along the central longitudinal axis 32 of cover 14 from a closed end 34 of canister 26 to an open end 36 of canister 26. The canister 26 includes a rear portion 38 which has a larger cross-section than the front portion 39 of canister 26. The canister 26 and sleeve 28 are dimensioned and arranged so that the rear portion 38 of canister 26 is slip fit into and surrounded by sleeve 28. Canister 26 extends distally of the end of sleeve 28. Further, sleeve 28 extends proximally beyond the open end 36 of canister 26 to an open end 40. The applicator 12 and sleeve 28 are dimensioned and arranged so that they fit together. In other words, the open end 40 of sleeve 28 is dimensioned and arranged to receive the forward portion 20 of applicator 12.

As an idea of size, the illustrated dispenser 10 is about ten centimeters long. Of course, this dimension is not critical. The length of hollow handle 16 may be varied depending, for example, on the cosmetic to be applied. Thus, if lipstick is to be applied hollow handle 16 may be relatively short, while if eye make-up is involved, the hollow handle 16 may be relatively long. Since applicator 12 plays no part in cosmetic extrusion, it can be designed and configured solely as an instrument to apply the particular cosmetic involved. In addition, the illustrated applicator 12, canister 26 and sleeve 28 are cylindrically shaped, with the applicator 12 and sleeve 28 being about one centimeter in diameter. Various other shapes and sizes can be used.

The applicator 12 is securable in sleeve 28. Thus, the sleeve 28 includes an annular groove 42 near the open end 40 that faces radially inward to receive the plug 18 periphery. This arrangement results in the sleeve 28 engaging the applicator 12 in a snap-together fit that retains the sleeve 28 on the applicator 12 while enabling rotational movement of the applicator 12 relative to the sleeve 28 while applicator 12 is being retained by sleeve 28.

Relative movement between canister 26 and sleeve 28 is used according to the broader aspects of the invention to drive an extrusion mechanism contained within the canister 26. The extrusion mechanism operates to extrude an amount of the cosmetic toward the open end 36 of the canister 26 when the canister 26 is rotated relative to the sleeve 28.

The extrusion mechanism includes components that result in such operation and, thus, these components serve as means for enabling the user to operate the extrusion mechanism by moving the canister 26 relative to the sleeve 28, whether the tip 24 is in or out of the open end 40 of sleeve 28. This feature results in much more convenient operation, as discussed hereinafter.

The extrusion mechanism mentioned above includes a piston 44 within the compartment 30 of the canister 26. A shaft 46 composed of a suitable material, such as steel, is disposed within the compartment 30 and extends generally along the axis 32 between first and second end portions 48 and 50 of the shaft 46. First end portion 48 of shaft 46 is received in indent 51 in the closed end 34 of canister 26 and rotates freely relative to canister 26.

At least a portion of the shaft 46 is threaded. The shaft 46 passes through the piston 44 so that rotation of the shaft 46 relative to the canister 26 causes the piston 44 to move relative to canister 26. The piston 44 engages threads on the shaft 46.

In this regard, the piston 44 may be composed of an injection molded thermoplastic material and define a hole through which the shaft 46 passes. Radially inwardly protruding members around the hole periphery serve to engage threads on the shaft 46. These details of the piston 44 are not illustrated, and other known means of engaging the threads on the shaft 46 may be employed.

The canister 26 includes stop means for preventing the piston 44 from rotating with the shaft 46. This is accomplished in the dispenser 10 with a plurality of inwardly-protruding, longitudinally-extending ribs 52 formed on the interior wall of the canister 26. The piston 44 is suitably configured so that the ribs 52 engage the piston 44 to prevent rotation of the piston 44 while allowing axial movement. The piston 44 may have a circularly shaped periphery that deforms slightly to conform to the shape of the ribs 52, for example.

Thus, the extrusion mechanism mentioned above includes means for moving the piston 44 toward the open end 36 of the canister 26 when the extrusion mechanism is operated in order to thereby move a quantity of the cosmetic 54 within compartment 30 toward the open end 36.

The extrusion mechanism further includes a drive unit 55 which is press fit into and moves, e.g., rotates, with sleeve 28. The forward portion 56 of drive unit 55 is sized to receive and hold second end 50 of shaft 46 so that shaft 46 is stationary relative to sleeve 28. For example, the second end 50 of shaft 46 may be press fit into a hole in forward portion 56. Drive unit 55 enables the user to couple the shaft 46 to the sleeve 28 so that rotation of the sleeve 28 relative to the canister 26 causes the shaft 46 to rotate relative to canister 26. Drive unit 55 includes a pair of extrusion holes 58 through which cosmetic 54 is extruded from compartment 30.

The drive unit 55 may be composed of an injection molded thermoplastic material.

Figure 2:
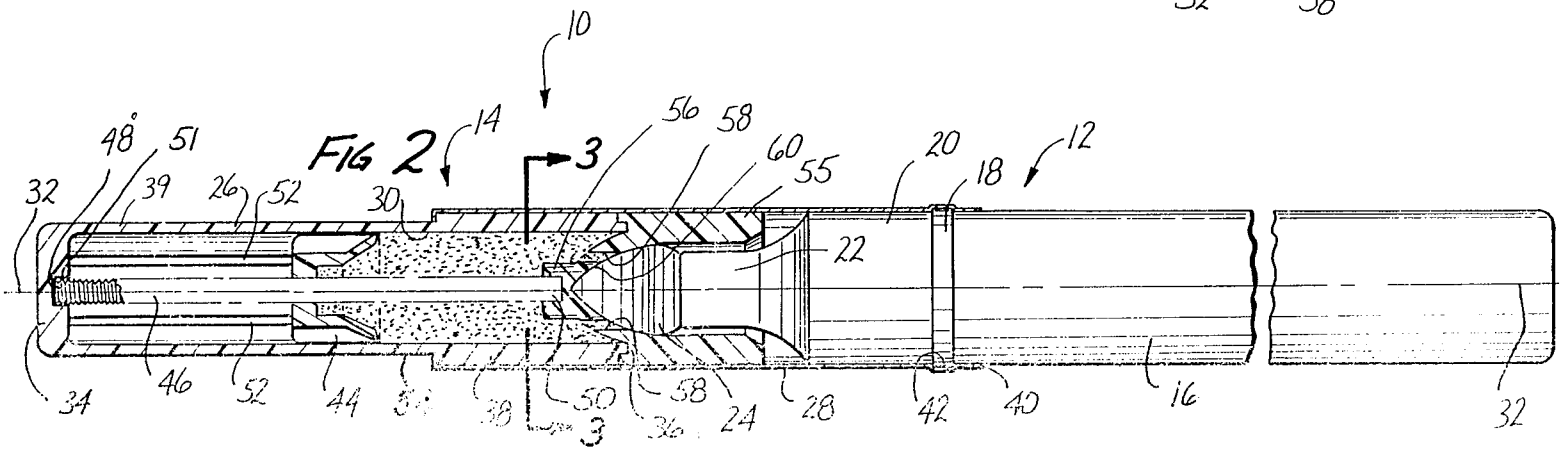
FIG. 2 is an enlarged cross-sectional view taken along line 2—2 in FIG. 1.

In assembling the dispenser 10, the manufacturer may first assemble the piston 44, the shaft 46, and the drive unit 55. Once assembled, they are inserted through the open end 36 into the compartment 30 of the canister 26, and a quantity of cosmetic 54 is injected into the compartment 30 through extrusion holes 58 in the drive unit 55. As seen in FIG. 2, the drive unit 55 defines a cavity opening toward the open end 40 of sleeve 28. The quantity of cosmetic 54 may be in a relatively less viscous state when it is injected, and the drive unit 55 may include a vent hole for venting air from the compartment 30 as the cosmetic 54 is injected.

The sleeve 28 can then be positioned to be slip fit onto canister 26 and press fit onto drive unit 55.

When the canister 26 is rotated relative to sleeve 28, shaft 46 rotates and the piston 44 moves axially while the ribs 52 prevent rotation of piston 44. By rotating sleeve 28 relative to canister 26 in such a way that piston 44 moves toward open end 36 of canister 26, the piston 44 moves the cosmetic 54 toward the open end 36 so that the cosmetic 54 passes through extrusion holes 58, ready to be picked up and applied by tip 24 of applicator 12.

In order to extrude the cosmetic 54 (i.e., advance it onto the tip 24), the user rotates the canister 26 relative to the sleeve 28. This is done by grasping the canister 26 with one hand and the sleeve 28 with the other hand and then rotating the two relative to each other. Doing this results in the drive unit 55 and the shaft 46 rotating relative to canister 26, and this, in turn, results in the piston 44 moving to extrude an amount of cosmetic 55 through extrusion holes 58. This extrusion can be accomplished with applicator 12 remaining in place as shown in FIG. 2. Thus, the chances of misplacing the applicator 12 are advantageously reduced. With applicator 12 in place as shown in FIG. 2, tip 24 covers the extrusion holes 58.

After extruding some cosmetic in this manner, the user separates the applicator 12 from the sleeve 28, uses the cosmetic-covered tip 24 to apply the cosmetic as desired. If the user desires to redistribute the cosmetic on tip 24 and/or to obtain more cosmetic from the space 60 in which the tip 24 is located when applicator 12 and cover 14 are fitted together without extruding more cosmetic from compartment 30, the user simply places tip 24 back into space 60 as shown in FIG. 2. The user can then rotate the tip 24 relative to sleeve 28. This rotation redistributes the cosmetic on tip 24 and/or allows more cosmetic (which has already been extruded through extrusion holes 58) in space 60 to be applied to tip 24. This rotation does not result in more cosmetic being extruded. Thus, the user can use applicator 12 to very effectively apply the cosmetic without being concerned that rotating applicator 12 will cause excessive cosmetic extrusion. Once the cosmetic has been applied, as desired, the applicator 12 and cover 14 are rejoined, as shown in FIG. 2, and dispenser 10 is then ready to be stored.

This invention provides a new cosmetic dispenser that can be used to extrude cosmetic without directly involving the applicator 12. In addition, the user can spread the cosmetic more evenly over the surface of the applicator tip 24 for more effective cosmetic application.

While the invention has been described with respect to various specific examples and embodiments, it is to be understood that the invention is not limited thereto and that it can be variously practiced within the scope of the following claims.

What is claimed is:

1. A dispenser comprising:

a cover member defining a compartment;

a flowable cosmetic in said compartment;

said cover member including first and second cover portions movable relative to each other;

an applicator member including an applicator tip for flowable cosmetic application purposes, said applicator member and the cover member being separable; and an extrusion mechanism including means carried by said cover member defining an extrusion hole, said extrusion mechanism being in said compartment and being responsive to relative movement between the first and second cover portions for extruding flowable cosmetic from the compartment through the extrusion hole onto the applicator tip without passing through said applicator tip.

2. The dispenser of claim 1 wherein said first cover portion has a closed end and an opposing open end, said second cover portion has opposing first and second open ends, and said cover member is configured so that said closed end of said first cover portion extends distally beyond said first open end of said second cover portion and said second open end of said second cover portion extends proximally of said open end of said first cover portion.

3. The dispenser of claim 2 wherein said first cover portion and said second cover portion overlap each other.

4. The dispenser of claim 3 wherein said second cover portion substantially surrounds said first cover portion over the area of overlap.

5. The dispenser of claim 1 wherein at least a portion of said first cover portion is at least partially transparent.

6. A dispenser as defined in claim 1 wherein said first and second cover portions are rotatable relative to each other, said extrusion mechanism includes a piston in said compartment and including means for moving said piston in response to relative rotation between said first and second cover portions.

7. A dispenser as defined in claim 6 wherein said means defining an extrusion hole is carried by said second cover portion and is rotatable with said second cover portion and said moving means includes a threaded shaft drivingly coupled to said piston and mounted on said means defining an extrusion hole for rotation therewith.

8. A dispenser as defined in claim 7 wherein said cover member includes stop means for preventing the piston from rotating relative to the first cover member.

9. A dispenser as defined in claim 8 wherein said stop means includes a plurality of longitudinally extending ribs on said first cover member.

10. A dispenser for a flowable substance comprising:

an applicator member including an applicator tip for use in applying the flowable substance, a canister having a compartment adapted to contain a supply of flowable substance;

a sleeve having a hollow interior, said sleeve receiving a portion of said canister and being movable relative thereto, said sleeve being adapted to receive said applicator tip;

an extrusion member mounted in the hollow interior of said sleeve, said extrusion member having a cavity opening away from said canister and an extrusion hole leading to said cavity, and said applicator tip being receivable into said cavity to cover said extrusion hole; and an extrusion mechanism located at least partially within said compartment and being responsive to relative movement between the sleeve and the canister for extruding flowable substance from said compartment through the extrusion hole and onto the applicator tip.

11. The dispenser of claim 18 wherein said extrusion mechanism includes a piston located within said compartment, and means for moving said piston axially in said compartment in response to rotating said canister relative to said sleeve.

12. The dispenser of claim 11 wherein said means includes a shaft within said compartment, situated relative to said piston so that rotation of said shaft causes said piston to move relative to said shaft.

13. The dispenser of claim 12 wherein said, extrusion member acts to hold said shaft stationary relative to said sleeve.

14. The dispenser of claim 13 wherein said canister is slip fit into said sleeve and said extrusion member is press fit into said sleeve.

15. A dispenser as defined in claim 10 wherein said canister and said sleeve are rotatable relative to each other and said extrusion member is rotatable with said sleeve, and said extrusion mechanism is drivingly coupled to said extrusion member so that the extrusion mechanism can respond to relative rotation between the sleeve and the canister to extrude flowable substance from the compartment through the extrusion hole and onto the applicator tip.

16. A dispenser as defined in claim 15 wherein said extrusion mechanism includes a threaded shaft coupled to said extrusion member for rotation therewith and a piston mounted on said shaft and responsive to relative rotation between the sleeve and the canister for extruding flowable substance from the compartment through the extrusion hole and onto the applicator tip.

17. A dispenser for a flowable substance comprising:

an applicator member including an applicator tip of foam material for use in applying the flowable substance;

a canister having a compartment adapted to contain a supply of flowable substance, said canister having a closed end and an open end;

a sleeve having a hollow interior and open opposite ends, said sleeve receiving a portion of said canister and being rotatable relative thereto, said sleeve projecting beyond the open end of the canister and being adapted to receive said applicator tip;

a drive unit mounted in the hollow interior of said sleeve and rotatable with said sleeve, said drive unit having a cavity opening away from said closed end of said canister and an extrusion hole leading from the compartment to said cavity, and said applicator tip being receivable into said cavity to cover said extrusion hole; and an extrusion mechanism located in said compartment and drivingly conveyed to the drive unit, said extrusion mechanism being responsive to relative rotation between the sleeve and the canister for extruding flowable substance from said compartment through the extrusion hole and onto the applicator tip.

* * * * *

UNITED STATES PATENT AND TRADEMARK OFFICE

CERTIFICATE OF CORRECTION

PATENT NO. : 4,976,562

DATED : December 11, 1990

INVENTOR(S) : James R. Spivey

It is certified that error appears in the above-identified patent and that said Letters Patent is hereby corrected as shown below:

Column 4, line 45 after "unit" insert -- or extrusion member --.
Column 6, line 1 before "member"
insert -- tip being receivable in said cover member and the applicator --.

Column 7, line 1 change "claim 18" to -- claim 10 --.

Column 7, line 10 after "said" delete the comma.

Column 7, line 14 change "extrusion member" to -- drive unit --.

Column 8, line 23 change "conveyed" to -- coupled --.

Signed and Sealed this

Eleventh Day of August, 1992

*Attest:*

DOUGLAS B. COMER

*Attesting Officer*

*Acting Commissioner of Patents and Trademarks*